US005384562A

United States Patent [19]

Greenfield

[11] Patent Number: 5,384,562

[45] Date of Patent: Jan. 24, 1995

[54] EARLY WARNING HEAT SENSOR SYSTEM

[76] Inventor: Arnold Greenfield, 840 NE. 199th St., North Miami Beach, Fla. 33179

[21] Appl. No.: 17,785

[22] Filed: Feb. 16, 1993

[51] Int. Cl.[6] ..... G08B 17/06

[52] U.S. Cl. ..... 340/584; 340/586; 340/590; 340/593

[58] Field of Search ..... 340/584, 593, 590, 586

[56] References Cited

U.S. PATENT DOCUMENTS

| | | | |
|---|---|---|---|
| 2,487,526 | 11/1949 | Dahm et al. | 340/590 |
| 3,064,222 | 11/1962 | Reniert | 338/25 |
| 3,221,319 | 11/1965 | Undenberg, jr. | 340/514 |
| 3,271,719 | 9/1966 | Oushinslly | 338/28 |
| 3,521,131 | 7/1970 | Buzzelli | 361/434 |
| 3,872,419 | 3/1975 | Groves et al. | 338/25 |
| 4,319,485 | 3/1982 | Terada et al. | 340/584 |
| 4,572,862 | 2/1986 | Ellis | 428/245 |
| 4,651,121 | 3/1987 | Furubayashi et al. | 338/35 |
| 4,661,398 | 4/1987 | Ellis | 428/245 |
| 4,760,368 | 7/1988 | Sugihara et al. | 338/34 |
| 4,768,012 | 8/1988 | Williams et al. | 338/34 |
| 4,818,595 | 4/1989 | Ellis | 428/245 |
| 5,039,454 | 8/1991 | Palicastro et al. | 252/610 |

OTHER PUBLICATIONS

Publication Product Data; DP-90-3046 "Koroseal Wallcoverings" (formerly BF Goodrich Wallcoverings, 2 pages).

*Primary Examiner*—Glen Swann

*Attorney, Agent, or Firm*—Herbert L. Lerner; Laurence A. Greenberg

[57] ABSTRACT

A heat-sensitive alarm trigger is used to set off a fire alarm system having an alarm circuit with a rated trigger resistance. The alarm circuit is triggered when a resistance across two sensor leads, between which the alarm trigger is connected, falls below the rated trigger resistance. The heat-sensitive alarm trigger comprises a laminate structure which includes an optionally perforated first electrode layer and a second electrode layer. A barrier material layer which is disposed between the two electrode layers has a resistance above the rated trigger resistance. A layer of hydrated material is disposed on the perforated electrode layer. When the hydrated material is heated above a given alarm trigger temperature, moisture is given off through the holes in the first electrode and, as a result, the barrier layer becomes sufficiently conductive so as to lower a resistance across the electrodes to below the rated trigger resistance. In the alternative, the hydrated layer is the barrier layer sandwiched between the electrodes. When the barrier layer reaches a given trigger temperature, its resistance falls below the rated trigger resistance, and the alarm circuit is triggered.

6 Claims, 7 Drawing Sheets

EARLY WARNING HEAT SENSOR SYSTEM

BACKGROUND OF THE INVENTION

1. Field of the Invention

The invention relates to a heat sensor system, and particularly to an alarm trigger and a heat sensor used as a triggering device in a fire alarm.

Residential and industrial fire detection systems may be broadly categorized as smoke alarms and heat-sensor triggered alarms. The most recent figures available from the U.S. Fire Administration reveal that 6,000 lives were lost in a one-year span, and over $8 Billion of direct financial losses were sustained in the U.S. due to fires. While no national standard has been reached, a voluntary standard suggests heat sensors throughout the house and a smoke detector centrally disposed. There are mandatory as well as voluntary requirements. Costs for such a systems range from $10 for a single smoke alarm to well over $1,000 for a system with several smoke alarms and heat sensors.

The correct placement and use of fire alarms is considered by fire fighting authorities as one of the principal methods of fire control. Approximately 85% of homes, and virtually all commercial and industrial buildings in the U.S. are equipped with fire alarms of one type or another. The objective of the fire alarm is to emit a signal which alerts occupants to seek exits, activates fire suppression systems or otherwise notifies fire control personnel.

2. Description of the Related Art

There are several systems for classifying the stages of fire. One of the classification systems includes the following stages:

HEATING
DECOMPOSITION
IGNITION
COMBUSTION AND PYROLYSIS
PROPAGATION (FLAME SPREAD)
PENETRATION
"FLASHOVER" ( FULGURATION )
INCINERATION

Most prior art fire detection systems do not respond to the first three stages, and are activated only starting with the fourth stage (combustion and pyrolysis). Infrared detectors could pick up initial heating, if set for automatic detection. Such systems, however, are not widely used as they are expensive, difficult to install, operate and maintain, and they require proper strategic placement.

Several types of detectors are commonly in use: thermal sensors (thermostats, thermopiles and infrared sensors); smoke detectors (photo-electric and ionization detectors); and flame detectors; and product of combustion (gas) detectors. Each type has major drawbacks. Most depend on "line-of-sight", or proximity, for their efficiency, and are frequently blocked from "direct view" of the source locus of the fire.

In many fire alarm systems the sensor component of the system is attached directly to the alarm circuit. The fire signal is picked up from a distance, after a trajectory through intervening space. The sensitivity and thus the effectiveness of the alarm is thus strongly affected.

Since the objective of the alarm component is to alert inhabitants to impending danger, there are numerous types of system outputs to serve this function: sirens, bells, horns, buzzers, loudspeakers, flashing lights, telecommunication signals, etc.

Heat sensors, on the other hand, are based on fire detection by fusible links or other mechanical devices, such as bi-metal trigger probes. The response speed and sensitivity of these devices are essential engineering problems. Since heat sensors must be disposed at least one per room in order to be effective, the cost of installation therefor is quite substantial. In many instances, these devices must be replaced once they have been triggered, adding to the cost of maintenance.

One of the most popular smoke alarm devices is available under the trademark FIRST ALERT, as sold by PITTWAY Corp. Pitway says smoke detectors in general should not be placed in areas with a relatively high density of combustion particles, such as in kitchens, garages, near furnaces, hot water heaters and space heaters. Furthermore, such devices may be triggered by dust, which prevents their use in many industrial environments. Numerous other "forbidden" areas are listed for ionization or smoke detectors, such as in damp or very humid areas, very cold or very hot rooms, bathrooms, dirty areas, near air vents, insect-infested areas and near fluorescent lights.

SUMMARY OF THE INVENTION

It is accordingly an object of the invention to provide an early warning heat sensor system, which overcomes the hereinafore- mentioned disadvantages of the heretofore-known devices of this general type and which is accurately adjustable to a given threshold trigger temperature, which is inexpensive and which may be disposed in virtually any type of room.

The early warning heat sensor system according to the invention described herein is sensitive to the early stages of fire, and will detect heating (first stage) by the generation of free moisture in the sensor system, whereby an electrical circuit is closed activating the alarm.

In contrast to many prior art fire alarm systems, the sensors, for example continuous strips of metal foil, separated by hydrated cementitious materials, according to this invention are located away from the alarm, attached to the substrate, and connected to the alarm with small-diameter wire.

With the foregoing and other objects in view there is provided, in accordance with the invention, in a fire alarm system having an alarm circuit with at least one pair of sensor leads and a rated trigger resistance between the sensor leads below which the alarm is activated, a heat-sensitive alarm trigger, comprising:

two electrode means defining a space therebetween;

means for electrically connecting the two electrode means to an alarm circuit; and hydrated material disposed in the space between the two electrode means;

the hydrated material having a resistance below a rated trigger resistance of the alarm circuit when heated to above a given threshold trigger temperature.

In accordance with an added feature of the invention, the alarm trigger includes adhesive layers disposed between the two electrode means and the hydrated material.

In accordance with an additional feature of the invention, the two electrode means are elongated strips of metal foil or film.

In accordance with another feature of the invention, the two electrode means are sheets of aluminum foil covering plates of particle board or plywood board, or other cementitious material substrates.

Many different shapes and configurations of the basic principle of the invention are possible. Large boards, long strips of tape, moulding strips, picture frames, ceiling tile, etc. are but a few embodiments of the invention.

In accordance with yet another feature of the invention, the resistance of the hydrated cementitious material is adjusted by drying a sample of the material and comparing the specific weight of the sample with the specific weight of undried material.

With the objects of the invention in view, there further provided, in accordance with yet a further feature of the invention, a heat-sensitive alarm trigger in a fire alarm system having an alarm circuit with two sensor leads and a rated trigger resistance, the alarm circuit being triggered when a resistance across the two sensor leads falls below the rated trigger resistance of the alarm circuit; the heat-sensitive alarm trigger comprising: a laminate structure including a first electrode layer having openings formed therein and a second electrode layer, a layer of barrier material layer being disposed between the first and second electrode layers and having a resistance above the rated trigger resistance, a layer of hydrated material disposed on the first electrode layer, and means for electrically connecting the first and second electrode layers between the sensor leads of the alarm circuit; the hydrated material having a degree of hydration sufficient to give off moisture to the barrier material through the openings when the hydrated material reaches a given temperature and to lower the resistance of the barrier material layer to below the rated trigger resistance.

In accordance with a concomitant feature of the invention, the barrier material layer is formed of paper, a dielectric in its dry state.

Other features which are considered as characteristic for the invention are set forth in the appended claims.

Although the invention is illustrated and described herein as embodied in an early warning heat sensor system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
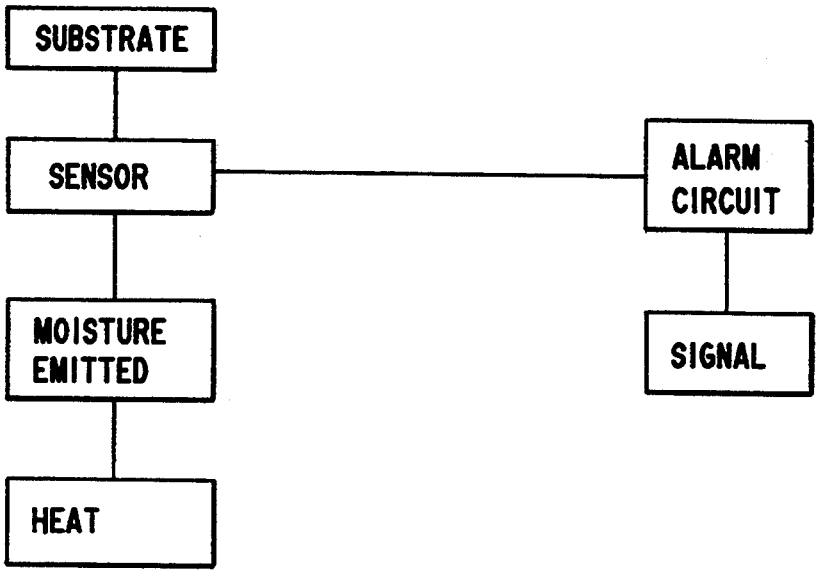
FIG. 1 is a block diagram showing various components of a fire alarm system according to the invention.

Referring now to the figures of the drawing in detail and first, particularly, to FIG. 1 thereof, there is seen a block diagram of an alarm system according to the invention.

Figure 2A:
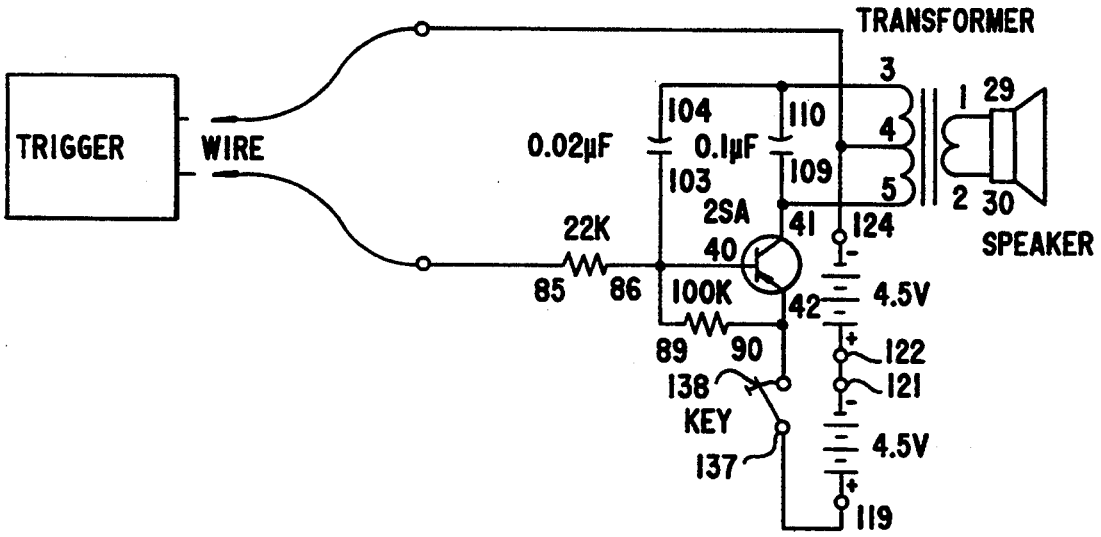
FIGS. 2*a* and 2*b* show two alternative prior art circuits connected to a trigger according to the invention.
Figure 2B:
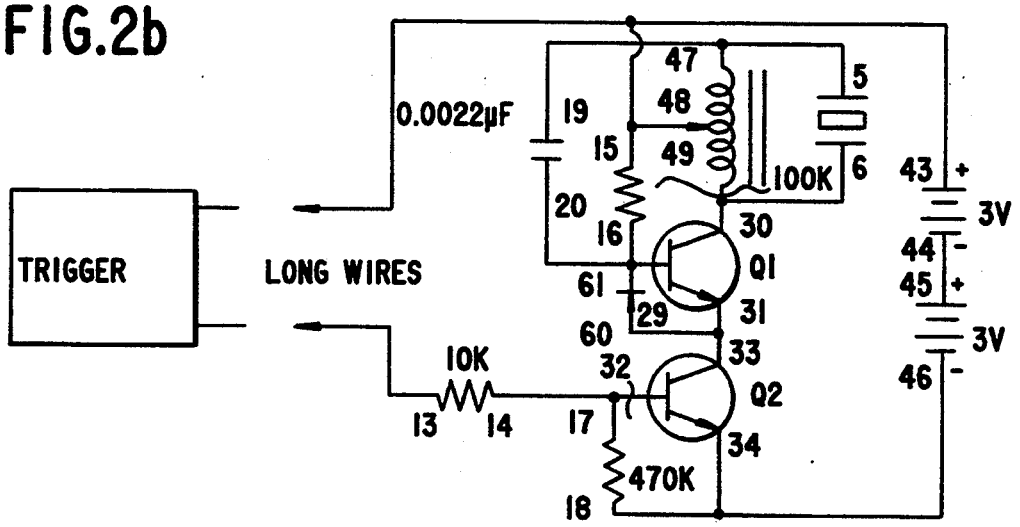

No claim is made to novelty for the electrical alarm circuitry utilized in this invention. Several types of commercially available circuits work with the sensor and trigger system according to the invention. Two typical prior art circuits are shown in FIGS. 2*a* and 2*b* (Radio Shack Science Fair Kit, Electronic Project Lab Catalog #28-259, "52Rain Detector" "126-Rain Detector"). The person of skill in the art will understand how to calibrate the circuit to the respective application. In other words, the threshold resistance of the circuit must correspond to the resistance provided by the trigger according to the invention. The illustrated prior art circuits, for example, are rated at a threshold resistance of 250 kΩ.

Reference will be made in the following to PYROTITE, which is commercially available from Pyrotite Coatings of Canada, Vancouver, B.C., Canada. U.S. Pat. Nos. 4,572,862 (Fire Barrier Coating Composition), 4,818,595 (Fire Barrier Coating) and 4,661,398 (Fire-Barrier Plywood), all to Harold Ellis of Miami, are herewith incorporated by reference.

A flexible laminate sold by Stel Industries, in the form of a Pyrotite coating on paper or cotton mesh multi-component aqueous laminate, comprises mutually compatible and synergistic series of hydraulic-setting and chemical-setting inorganic cements, which, when air dried, form a hard, refractory, crack-free abrasion-resistant, impact-resitant, non-combustible flexible coating. The material is capable of withstanding exposure to 2000° F. (1093° C.), and may be applied to any flexible substrate.

The two-component coating includes a base component in powder form an intimately blended mixture of several different inorganic cementitious powders and fillers: and a liquid fluid component, termed the activator, hardener or curing solution which, when mixed in stoichiometrically correct proportions, cures the coating.

Figure 3:
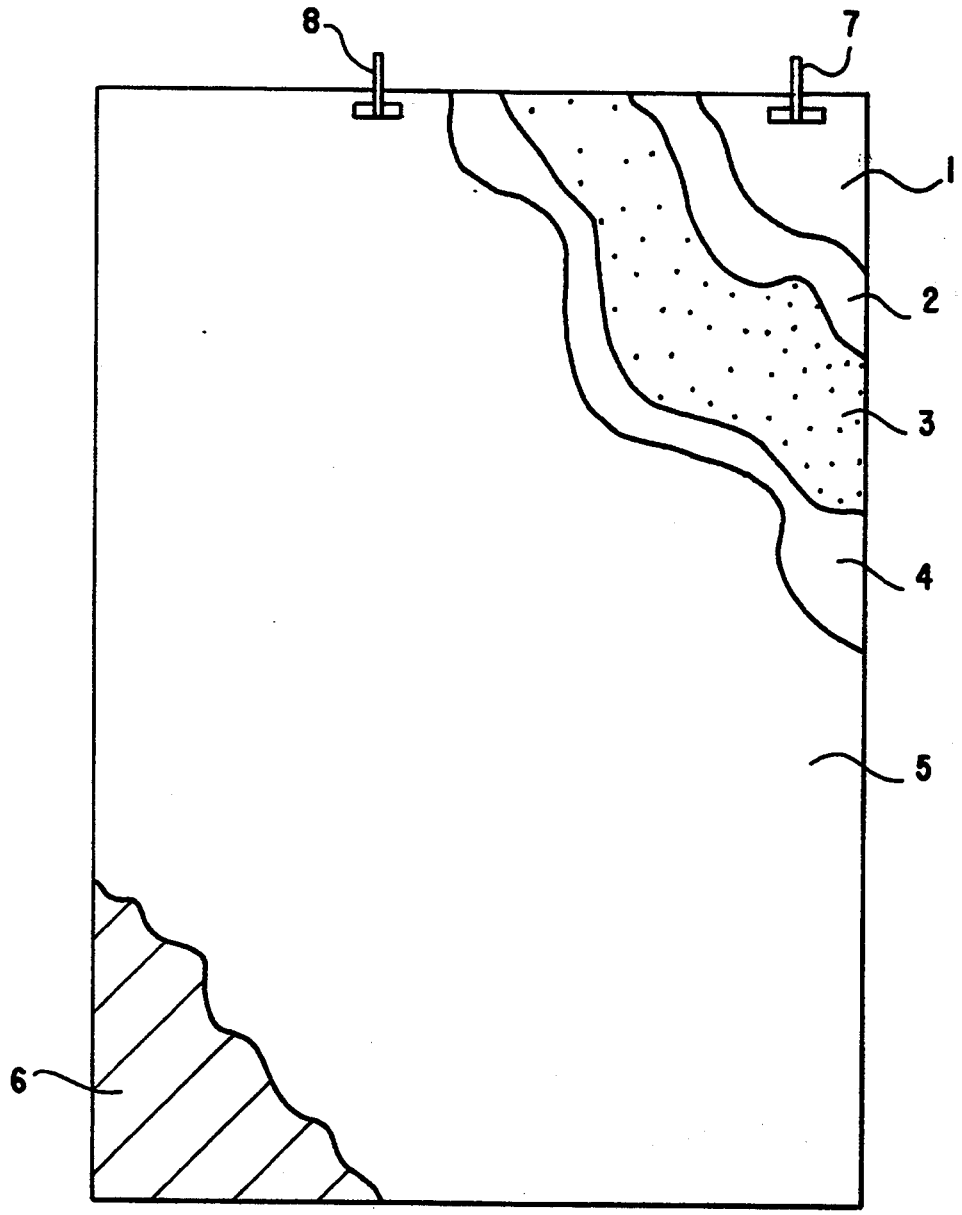
FIG. 3 is a partly broken-away view of a trigger laminate according to the invention.
Figure 4A:
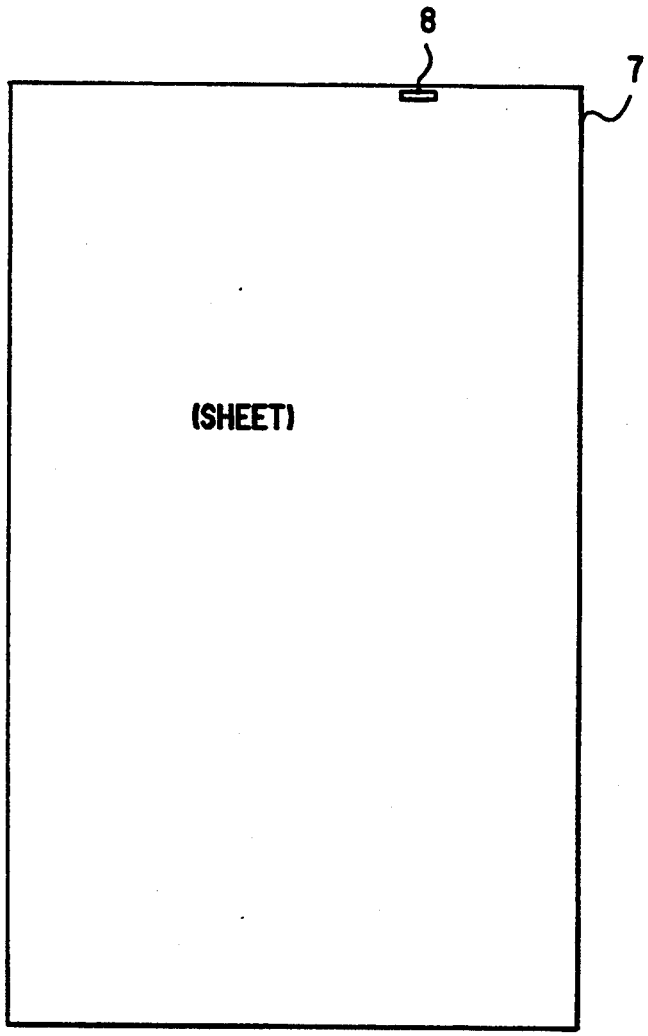
FIGS. 4*a* and 4*b* are side-elevational view of several shapes of an embodiment of the invention.
Figure 4B:
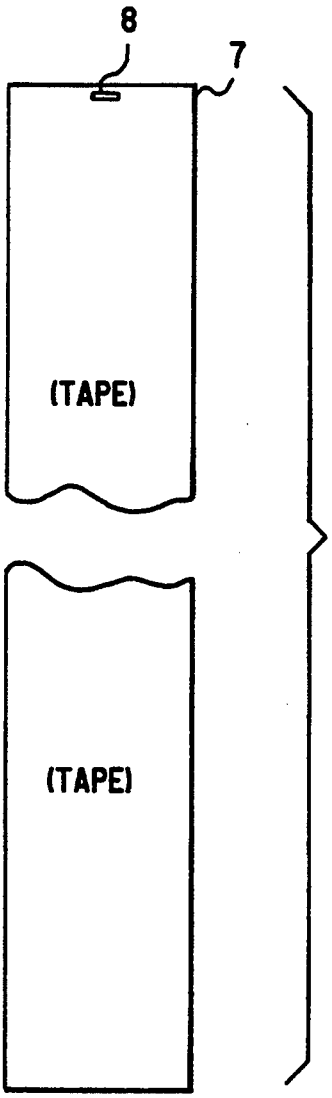
Figure 4C:
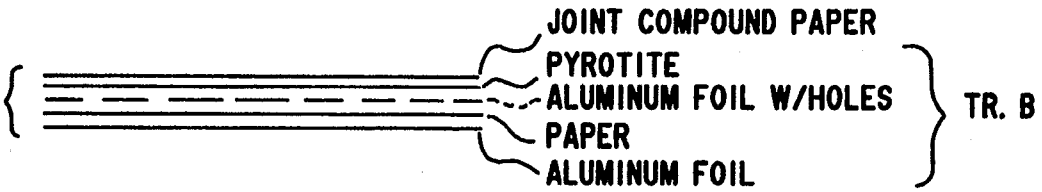
FIGS. 4*c*–4*h* are diagrammatic sectional view of various embodiments of the invention.
Figure 4D:
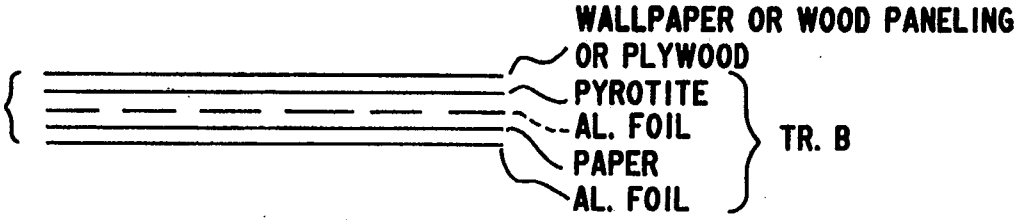
Figure 4E:
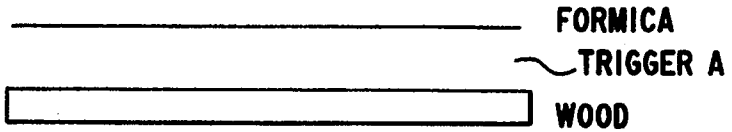
Figure 4F:
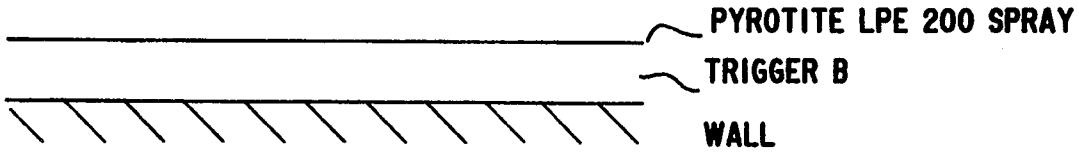
Figure 4G:
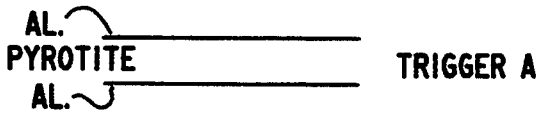
Figure 4H:
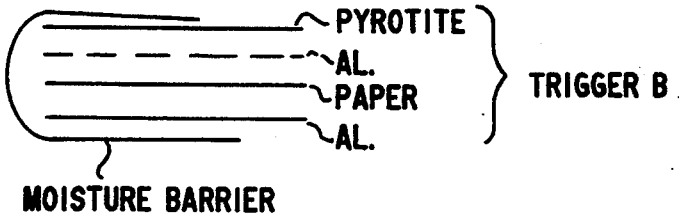
Figure 5A:
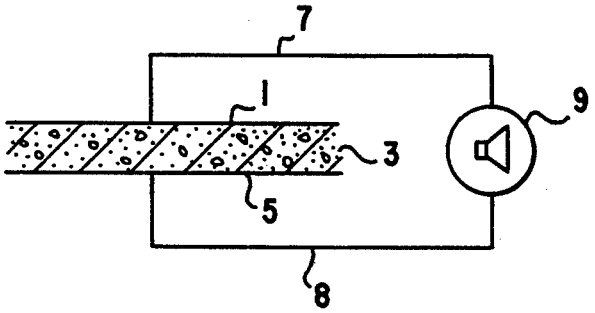
FIGS. 5*a* and 5*b* show diagrammatic views of the trigger according to the assembly acting as a battery cell and a source of emf.
Figure 5B:
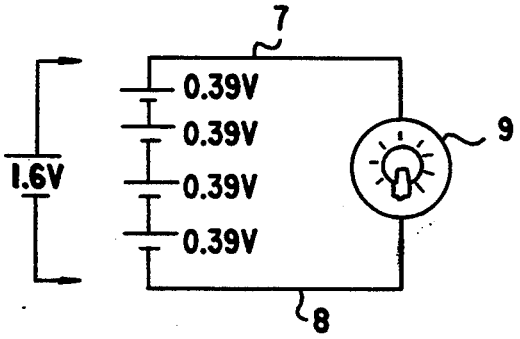

With reference to FIG. 3 which shows a first embodiment of a thermal sensor according to the invention, a multi-layer laminate includes an electrically conductive metal foil 1, an adhesive layer 2, a hydrated dielectric layer 3, a second adhesive layer 4, another metal foil 5 and a decorative layer 6. The laminate emits moisture from the core hydrated dielectric layer 3 upon being heated to a pre-determined temperature. As best understood, the ionically conductive moisture closes the circuit between wires 7 and 8 (at a rated temperature the rated threshold resistance is reached) which activates a central alarm.

The laminate essentially consists of two electrodes in the form of the two electrically conductive sheets 1 and 5, which sandwich therebetween the central hydrated dielectric layer 3 which forms the core. Upon heating of the laminate at any point thereof, for example from heat building up prior to flaming, the circuit between wires 7 and 8 is closed. As best understood, the core of the laminate, the hydrated dielectric layer 3, emits moisture which provides the necessary ionic conductivity.

The disclosure is, of course, not limited to the aluminum foils 1 and 5. Any type of electrically conductive materials can be used to form the electrodes, such as metal foils (aluminum, copper, etc.), metallized films; conductive coatings (graphite, carbon black, iron oxide, etc); conductive paints. Similar, many types of hydrated (water containing) dielectric materials can be used for the core or layer 3, such as paper, cardboard, plastic films, paint, or coatings, plaster, concrete, etc. It will be recognized by persons skilled in the art that the listing of such materials is not complete. Many other materials may be substituted which meet the performance requirements of the system.

Electrical contact is made by the use of terminals attached anywhere to the conductive layers. To avoid short circuits, engineering layout and fabrication of the system must ensure that the conductive layers are not in contact at any point (separation by the dielectric layer must be complete); and that the terminals are isolated and in contact only with their proper conductive layer.

The laminates may be very thin (1–20 mils) or quite thick (20–100 mils). They can be in the form of sheets, or strips, or tapes, and of any practical size. Sheets may be 16′×40′; tapes may be ½″–3″, 100′ to 120′ long. In a very advantageous embodiment of the invention, conventional joint compound tape may be augmented with the trigger mechanism. Any voltage drop across the length of the wire connections appears to be negligible. The parameter "mil" is defined in the equation 125 mils=⅛ inch.

With reference to FIGS. **4*c*–4*h***, the inventive trigger may be placed in a number of different environments. Several exemplary embodiments are shown, for instance a trigger with joint compound paper, with vinyl wall paper, with wood panelling, plywood, sandwiched between formica and wood or a layer of PYROTITE sprayed onto the trigger, which is attached to a wall.

Two inventive triggers are described. The first trigger, referred to as trigger A, is a "sandwich" of metal layer—hydrated barrier material—metal layer. In other words, the source of the conductivity-providing ions is the barrier material itself. The second trigger, referred to as trigger B, is a structure formed of a metal conductor, a barrier material (resistor), a perforated metal conductor and a hydrated material thereon. Upon being heated the hydrated material gives off moisture to the barrier material through the perforations, such that the resistance of the barrier material is lowered below the trigger resistance of the alarm.

Electric power in the alarm circuit is generally supplied by batteries (9 V d.c.) which form a component of the alarm system.

In a further embodiment of the invention, however, the trigger itself may act as a battery when it reaches a certain temperature. With reference to FIGS. **5*a* and 5*b*, the core 3 becomes an ion-conducting electrolyte and the two electrodes 1 and 5 behave as donor and acceptor, respectively. Measurements with this device have shown that the potential difference across the laminate from layer 1 to layer 5 corresponds exactly to the rated materials. For instance, if one of the foils is aluminum, the core is a 12 mils sheet of PYROTITE, and the other foil is silver-plated, the voltage across the configuration is measured at 0.39 V (the accepted rating of an Al-Ag electrolyte cell is 0.395 V). A plurality of ten such trigger "batteries" will thus provide an emf of 3.9 V. A combination of Al-Cu batteries will provide a multiple of 0.57 V. Due to the possible size of the laminate sheets according to the invention, sufficient current intensity may be obtained from the device. In this case, no alarm circuitry is necessary, as an indicator 9**, such as a buzzer or a bulb is triggered as soon as a sufficient emf is produced. This is the case when the laminate is heated to above the rated trigger temperature.

Figure 6:
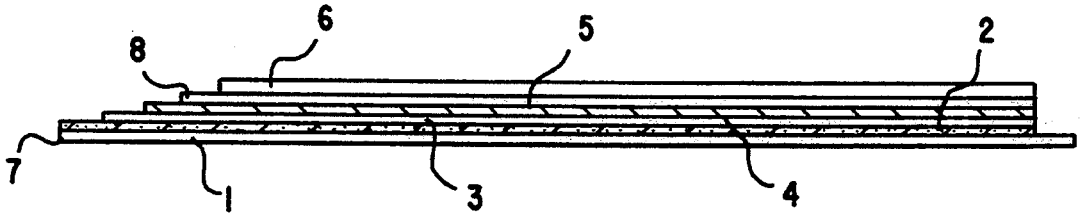
FIG. 6 is a cross-sectional view of a laminate according to the invention.

With reference to FIG. 6, the individual layers 1–6 of the laminate are adhesively bonded together. The laminate may be bonded to a flammable substrate. It is understood that the decorative layer 6 is but an option. The adhesive layers 2 and 4 may be comprised of only a few spots of adhesive distributed over the surfaces. It has been known for some time to cover sheetrock with aluminum foil for heat insulation purposes. As mentioned, the electrical conductor layer may be in the form of a metal foil, conductive paint, sputtered film, strips of tape, etc.

In staying with the above embodiment of the invention, an exemplary situation is described: A room of a house has sheetrock walls. The sheetrock boards forming the walls are covered with a laminate which comprises two aluminum layers with a thin layer of PYROTITE coating sandwiched therebetween. The aluminum layers 1 and 5 are electrically connected to a central alarm circuit through wires 7 and 8 which extend from the room to the central location. The outer aluminum layer is covered with a decorative top layer 6, such as vinyl wall paper. At the initiation of a fire, i.e. before the actual smoking and flaming, heat is generated in the heat-up stage. The heat source warms up the laminate with a temperature gradient decreasing radially outwardly from a source location. When the temperature at the outer aluminum layer, i.e. the layer below the decorative layer, reaches the predetermined trigger level of, say, 125° F., the PYROTITE layer becomes sufficiently conductive so as to trigger the central alarm.

Temperature gradients under atmospheric conditions are well known, i.e. the gradient in air is approximately a linear function of the inverse distance from the source. A sudden drop in the gradient occurs across the boundary layer (decorative layer 6) between the air and the trigger laminate. The intensity of that drop depends on the decorative layer and may be determined with a very simple experiment, such as heating one side of the material and measuring the temperature on both sides of the material. Triggering experiments have been conducted by the inventor of the instant application as illustrated below in table I.

As far as understood, ionically conductive free moisture is emitted from the dielectric core of the laminate, thus closing the circuit between the two electrodes 1 and 5. The alarm circuit may be of a flip-flop type, so that only a short closing of the trigger will set the alarm off and leave the same in the on state after the circuit ceases to be closed. As explained, the release of moisture in the laminate core and the heat applied thereto may lead to the dissipation of moisture, the core dries out and again becomes a dielectric. It is noted, in this context, that the alarm system is triggered if only a very small portion of the contiguous laminate becomes conductive. The trigger remains conductive (alarm on) as long as free moisture is present. When the temperature is lowered and moisture is again confined within the dielectric, the trigger is deactivated.

In this respect, in a further embodiment of the invention, the above-described laminate is enclosed by a moisture seal. A thin coat of plastic, for instance, or a wrapper of impermeable material will prevent any moisture from escaping from the laminate. Also, no moisture is allowed to enter the system. Accordingly, very accurate setting of the trigger temperature (adjusting the water content) is possible.

The accuracy of the system appears to depend on the hydration of the dielectric layer which becomes conductive when heated. A number of experiments have been conducted. The coating PYROTITE, for instance, is best adjusted by providing a slurry mix with a high water content, curing the slurry into the required form and then drying the structure to a given weight.

Since moisture is emitted at the point of the initial heat-up, in intimate contact with the incipient fire, this placement of the thermal sensor permits most rapid and sensitive response to activating the alarm. It will be clear that the alarm circuitry may be responsive to the location of the trigger which has become conductive. For example, each connecting electrode pair may indicate not only the room but even the exact wall or ceiling where it has been triggered.

Figure 7:
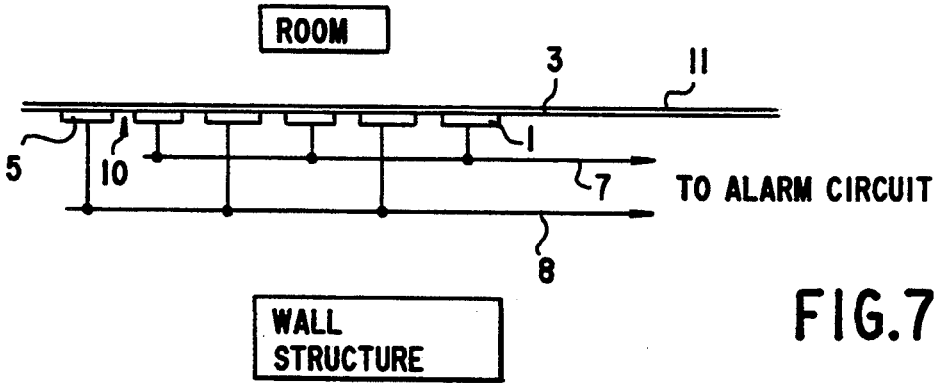
FIG. 7 is a side-elevational view of a further embodiment of the invention.

A further embodiment of the invention is illustrated in FIG. 7. Instead of sandwiching the quasi-dielectric 3, strips of the electrodes 1 and 5 are placed side by side, leaving a space 10 therebetween. The dielectric 3 is covered with wall covering, such as wall paper 11.

Figure 8A:
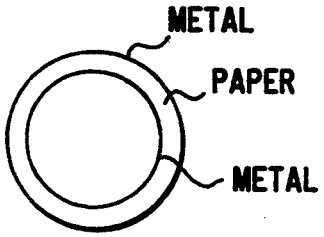
FIGS. 8*a* and 8*b* are a cross-sectional and a perspective view, respectively, of a further embodiment of the invention.
Figure 8B:
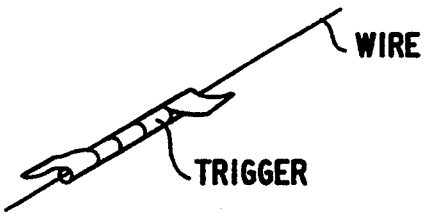

As a further example, reference is made to FIGS. 8*a* and 8*b*, which show the trigger of the invention used as a wire conduit. A variation of trigger A is used for that purpose, namely a metal foil covered with a quasi-dielectric such as paper, which is covered with another metal foil. As shown in FIG. 8*b*, this embodiment of the invention may be in the form of a broad tape, for instance, wrapped around the wire or an inner wire conduit. In the alternative, the trigger may be in the form of semi-rigid pipes of various lengths. It will be understood that the two metal layers must be connected to the respective alarm circuit leads.

The trigger temperature may be set in two different ways: Firstly, it is possible to adjust the specific hydration of the paper insulating the metal layers from one another. Secondly, the trigger may have a given trigger resistance and the alarm circuit may be adjusted to that resistance in dependence of the temperature. A person of skill in the art will recognize that the trigger resistance of the circuit may be easily adjusted either by way of hard-wiring additional resistors or providing a user-operated adjustment control.

The following data are based on a triggering experiment. The trigger according to the invention was formed by two aluminum foils with a single sheet of paper sandwiched therebetween. One of the aluminum foils was perforated and covered with a layer of PYROTITE material (Type II - see U.S. Pat. No. 4,818,595; cols. 12, 13). Moisture released by the PYROTITE was able to reach the paper between the aluminum foils through the openings in the covered foil and thus close the trigger circuit. The aluminum foils were electrically connected to two wires which connected to an alarm circuit. The voltage drop across the length of the wires was virtually negligible. The alarm circuit used for the experiment was a circuit from a FIRST ALERT smoke alarm (model #83R) of the PITTWAY Corporation. The following results were obtained:

TABLE I

| Substrate Material | Temp. | Trigger time | Signal |
|---|---|---|---|
| Paper | 600° F. | 20 sec | Y |
| Wood | 650° F. | 23 sec | Y |
| Fabric | 550° F. | 21 sec | Y |
| Wallboard | 212° F. | 15 sec | Y |
| Masking tape | 500° F. | 18 sec | Y |
| PYROTITE (type II) | 175° F. | 15 sec | Y |
| Vinyl wall covering | 165° F. | 10 sec | Y |
| | 170° F. | — | N |
| | 180° F. | 5 sec | Y |
| | 190° F. | 4 sec | Y |
| | 215° F. | 0 sec | Y |
| Gypsum | 212° F. | 10 sec | Y |
| Cardboard (30 mils) | 400° F. | 133 sec | Y |
| Paper (from legal pad) | 135° F. | 0 sec | Y |
| | 126° F. | 5 sec | Y |
| | 120° F. | — | N |
| Door skin* | | | |
| (Type I) | 80° F. | 0 sec | Y |
| (Type II) | 240° F. | 60 sec | Y |
| | 275° F. | 43 sec | Y |
| Paint (enamel based) | 170° F. | 2 sec | Y |
| Wall paper paste | 170° F. | 3 sec | Y |

*Door skin wood - 125 mils. Type I triggered immediately when aluminum foil of trigger touched the wood. Type II (dried in microwave) triggered as indicated.

In a further experimental setting, KRAFT paper-layered aluminum foil was utilized. Two such foils were placed back-to-back, i.e. Kraft paper on Kraft paper insulating the aluminum foils from one another. Two electrodes connected the respective aluminum surfaces to the alarm circuit. The alarm circuit was the same as the one used in the above experiment. The Kraft paper is glued to the Al foil, and it would appear that the adhesive layer provides the conductive ions.

TABLE II

| Material | Temp. | Trigger time | Signal |
|---|---|---|---|
| Aluminum foil on craft paper | 170° F. | 2 sec | Y |

It is understood that the triggering mechanism is a function of three main variables, namely temperature, moisture content and time. Each of the variables are easily adjusted by the person of skill in the art, depending on the required setpoint values.

As a further example, when a trigger is used on roofing plywood, the threshold trigger temperature of the device must be set to above 185° F. Furthermore, geographic data must be taken into account as, say, in Arizona and New Mexico roof temperatures are reached which are considerably higher than in Alaska, for example.

In a further embodiment, the novel trigger takes the form of ceiling tile. Such tile may be made from PYROTITE, for instance, with a layer of aluminum foil (perforated) on top, a sheet of the paper thereabove, and another aluminum foil on top of the paper. The two electrodes in the form of the metal foil may be interconnected among several ceiling tiles, for instance in series and/or in parallel, and then connected to the central alarm circuit.

A portable alarm device according to the invention is provided as an integral unit, including the novel trigger and the alarm circuit. The trigger laminate—in this case electrode-hydrated dielectric-electrode—may be placed directly on a surface to be sensed. This embodiment provides an alarm circuit which is very useful.

When placed on a hotel door from the inside, for instance, the device alerts the occupant of the room when the hallway or adjoining room has reached a temperature at which the door should not be opened. Placed on a wall adjoining a room, where otherwise a smoke detector would not be placed (e.g. a garage), adds additional options.

Many other possibilities are envisioned. To cite just one more, a picture frame (hanging or standing type) may for instance be provided with a trigger, and an alarm circuit may be placed in the frame itself.

As mentioned, PYROTITE type II is used in the preferred embodiments. A slurry is formed from 400 g MgO, 100 g high alumina calcium aluminate cement, 100 g silica, 15 g $TiO_2$, and 440 g of $MgCl_2$ and then cured. The degree of hydration of the material thus obtained is higher than the desired degree. Short baking (e.g. microwave treatment) removes various amount, of water from the material. It has been found that a reduction in the specific weight of the material in the range of about 2–6% raises its trigger temperature from about 70° F. (3 sec) to about 130° F. (5 sec).

I claim:

1. In a fire alarm system having an alarm circuit with at least one pair of sensor leads and a rated trigger resistance between the sensor leads below which the alarm is activated, a heat-sensitive alarm trigger, comprising:
   - two electrode means defining a space therebetween;
   - means for electrically connecting said two electrode means to said alarm circuit;
   - hydrated material disposed in said space between said two electrode means;
   - said hydrated material having a resistance below a rated trigger resistance of the alarm circuit when heated to above a given threshold trigger temperature;
   - said two electrode means being elongated strips of one of metal foil and film.

2. In a fire alarm system having an alarm circuit with two sensor leads and a rated trigger resistance, said alarm circuit being triggered when a resistance across the two sensor leads falls below the rated trigger resistance of the alarm circuit, a heat-sensitive alarm trigger comprising: a laminate structure including a first electrode layer having openings formed therein and a second electrode layer, a layer of barrier material being disposed between said first and second electrode layers and having a resistance above the rated trigger resistance, a layer of hydrated material disposed on said first electrode layer, and means for electrically connecting said first and second electrode layers between the sensor leads of the alarm circuit; said hydrated material having a degree of hydration sufficient to give off moisture to said barrier material through said openings when said hydrated material reaches a given temperature and to lower the resistance of said barrier material layer to below the rated trigger resistance.

3. In combination, an alarm circuit with two sensor leads and a rated trigger resistance between the sensor leads below which the alarm is activated, and a heat-sensitive alarm trigger, comprising:
   - two electrode means defining a space therebetween;
   - means for electrically connecting said electrode means to said sensor leads of said alarm circuit;
   - resistance means in the for of a thin sheet of paper disposed in said space between said two electrode means;
   - said resistance means having a resistance between said two electrode means above the rated trigger resistance when the trigger has a temperature below a temperature at which said alarm is to be triggered; and
   - said resistance means having a resistance below the rated trigger resistance of said alarm circuit when heated to above a given threshold trigger temperature.

4. In combination, an alarm circuit with two sensor leads and a rated trigger resistance between the sensor leads below which the alarm is activated, and a heat-sensitive alarm trigger comprising:
   - two electrode means defining a space therebetween;
   - means for electrically connecting said electrode means to said sensor leads of said alarm circuit;
   - resistance means in the form of paper disposed in said space between said two electrode means;
   - said resistance means having a resistance between said two electrode means above the rated trigger resistance when the trigger has a temperature below a temperature at which said alarm is to be triggered; and
   - said resistance means having a resistance below the rated trigger resistance of said alarm circuit when heated to above a given threshold trigger temperature;
   - wherein said electrode means are in the form of two coaxial cylindrical metal pipes and said resistance means are disposed between said metal pipes.

5. In a fire alarm system having an alarm circuit with at least one pair of sensor leads and a rated trigger resistance between the sensor leads below which the alarm is activated, a heat-sensitive alarm trigger, comprising:
   - two electrode means defining a space therebetween;
   - means for electrically connecting said two electrode means to said alarm circuit;
   - hydrated material disposed in said space between said two electrode means;
   - said hydrated material having a resistance below a rated trigger resistance of the alarm circuit when heated to above a given threshold trigger temperature; and
   - a layer of moisture-impermeable material enclosing said two electrode means and said hydrated material.

6. In combination an alarm circuit with two sensor leads and a rated trigger resistance between the sensor leads below which the alarm is activated and a heat-sensitive alarm trigger, comprising:
   - two electrode means defining space therebetween;
   - means for electrically connecting said electrode means to said sensor leads of said alarm circuit;
   - resistance means disposed in said space between said two electrode means;
   - said resistance means having a resistance between said two electrode means above the rated trigger resistance when the trigger has a temperature below a temperature at which said alarm is to be triggered;
   - said resistance means having a resistance below the rated trigger resistance of said alarm circuit when heated to above a given threshold trigger temperature; and
   - a layer of moisture-impermeable material enclosing said two electrode means and said resistance means.

* * * * *